US008097799B2

(12) United States Patent
Tran et al.

(10) Patent No.: US 8,097,799 B2
(45) Date of Patent: Jan. 17, 2012

(54) PLECTRUM RECEPTACLE SYSTEMS

(76) Inventors: Bac D. Tran, Mesa, AZ (US); Tina S. Tran, Mesa, AZ (US)

( * ) Notice: Subject to any disclaimer, the term of this patent is extended or adjusted under 35 U.S.C. 154(b) by 6 days.

(21) Appl. No.: 12/568,648

(22) Filed: Sep. 28, 2009

(65) Prior Publication Data

US 2010/0083810 A1 Apr. 8, 2010

Related U.S. Application Data

(60) Provisional application No. 61/102,756, filed on Oct. 3, 2008.

(51) Int. Cl.
*G10D 3/16* (2006.01)

(52) U.S. Cl. ..... 84/322; 84/329

(58) Field of Classification Search ..... 84/322, 84/329

See application file for complete search history.

(56) References Cited

U.S. PATENT DOCUMENTS

| | | | | | |
|---|---|---|---|---|---|
| 570,321 | A | * | 10/1896 | Mahler | 84/329 |
| 749,616 | A | * | 1/1904 | Knell | 84/329 |
| 1,570,905 | A | * | 1/1926 | Martell | 84/329 |
| 3,181,410 | A | | 5/1965 | Phillips | |
| 3,442,169 | A | | 5/1969 | Bowers | |
| 3,752,029 | A | * | 8/1973 | Watrous | 84/329 |
| 4,135,431 | A | * | 1/1979 | Ferguson | 84/329 |
| 4,637,236 | A | * | 1/1987 | Almblad | 70/458 |
| 4,785,708 | A | * | 11/1988 | Vaughan | 84/329 |
| 4,790,232 | A | * | 12/1988 | Rosen | 84/329 |
| 4,890,531 | A | * | 1/1990 | Tischer | 84/329 |
| D309,674 | S | * | 8/1990 | Gervase | D3/226 |
| 5,127,300 | A | * | 7/1992 | Silverman | 84/329 |
| 5,231,238 | A | * | 7/1993 | Adams | 84/329 |
| 5,299,485 | A | * | 4/1994 | Denton | 84/329 |
| 5,488,892 | A | * | 2/1996 | Jepsen | 84/322 |
| 5,649,634 | A | | 7/1997 | Irizarry | |
| D392,796 | S | * | 3/1998 | North | D3/204 |
| 5,796,021 | A | | 8/1998 | Longshore | |
| 5,847,299 | A | | 12/1998 | Zovko, Jr. et al. | |
| 5,905,217 | A | * | 5/1999 | Byers | 84/322 |
| 5,962,149 | A | * | 10/1999 | Kronzer | 428/32.1 |
| 6,040,512 | A | * | 3/2000 | Polley | 84/322 |
| 6,169,238 | B1 | * | 1/2001 | Bolo, III | 84/453 |
| D439,602 | S | * | 3/2001 | Morris, Jr. | D17/20 |
| 6,215,052 | B1 | * | 4/2001 | Giddens et al. | 84/329 |

(Continued)

OTHER PUBLICATIONS

Definitions of "against" cited at http://dictionary.reference.com/browse/against, viewed Jun. 5, 2011.*

*Primary Examiner* — Elvin G Enad
*Assistant Examiner* — Robert W Horn
(74) *Attorney, Agent, or Firm* — Stoneman Law Patent Group; Martin L. Stoneman; Eric Fish

(57) ABSTRACT

This invention relates to providing a plectrum holder device that may be easily attached to a guitar at the desired location of the guitar player. More particularly, this invention relates to providing a system for retaining multiple plectrums close to the surface of a guitar, in a low profile configuration, in a convenient location for easy access by the guitar player. Also, a guitar comprising the plectrum holder may still fit in its guitar case due to the low profile of the plectrum holder. Further, the plectrum holder holds picks of a variety of shapes and sizes.

21 Claims, 6 Drawing Sheets

U.S. PATENT DOCUMENTS

| | | | | |
|---|---|---|---|---|
| 6,259,009 | B1 * | 7/2001 | Bolo, III | 84/329 |
| 6,262,354 | B1 * | 7/2001 | Solomon, Jr. | 84/329 |
| 6,315,698 | B1 | 11/2001 | Barber | |
| 6,472,590 | B1 * | 10/2002 | Kulik | 84/453 |
| 6,639,136 | B1 | 10/2003 | Judd | |
| 6,791,017 | B2 | 9/2004 | Oskorep | |
| 6,933,430 | B2 * | 8/2005 | Oskorep | 84/322 |
| 7,078,604 | B2 * | 7/2006 | Rapaport | 84/322 |
| 7,417,184 | B2 * | 8/2008 | Weathersby | 84/322 |
| 7,566,824 | B2 * | 7/2009 | Small | 84/318 |
| 7,785,764 | B2 * | 8/2010 | Williams | 430/200 |
| 2004/0074369 | A1 | 4/2004 | Oskorep | |
| 2006/0032764 | A1 * | 2/2006 | Swenson | 206/232 |
| 2006/0096440 | A1 * | 5/2006 | Weathersby | 84/322 |
| 2007/0006713 | A1 * | 1/2007 | Dunlop | 84/322 |
| 2010/0083810 | A1 * | 4/2010 | Tran et al. | 84/322 |
| 2011/0100192 | A1 * | 5/2011 | Zink et al. | 84/322 |

* cited by examiner

PLECTRUM RECEPTACLE SYSTEMS

CROSS-REFERENCE TO RELATED APPLICATION

The present application is related to and claims priority from prior Provisional Application Ser. No. 61/102,756, filed Oct. 3, 2008, entitled "PLECTRUM RECEPTACLE SYSTEMS", the content of which is incorporated herein by this reference and is not admitted to be prior art with respect to the present invention by the mention in this cross-reference section.

BACKGROUND

This invention relates to plectrum receptacle systems. More particularly, this invention relates to providing a plectrum holder device that may be easily attached to a guitar at the desired location of the guitar player. Even more particularly, this invention relates to providing a system for retaining multiple plectrums, also known as "picks", close to the surface of a guitar in a convenient location for easy access by the guitar player.

Plectrum holders may be bulky and may require modification of the chordophone body for installation. A low profile plectrum-holding device would be most desirable since this would allow the chordophone to fit in its standard case or bag without removal of the plectrum holder.

OBJECTS AND FEATURES OF THE INVENTION

A primary object and feature of the present invention is to provide a system overcoming the above-mentioned problems.

It is a further object and feature of the present invention to provide a plectrum holder that has a low profile. It is a further object and feature of the present invention to provide a plectrum holder that conforms to the contours of the chordophone. It is a further object and feature of the present invention to provide a plectrum holder that is easily removable from the chordophone. It is a further object and feature of the present invention to provide a plectrum holder that allows plectrums of different shapes and sizes to be held. It is a further object and feature of the present invention to provide such a system allowing printing of graphics on the front and exposed surface of plectrum holder. It is a further object and feature of the present invention to provide entities that desire to market their product and brand are enabled by graphics reproduction process for customizing the look of the plectrum holder. A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a plectrum retainer system comprising: at least one plectrum retainer structured and arranged to retain at least one plectrum against at least one chordophone surface; and at least one angle positioner structured and arranged to position the at least one plectrum at least one acute angle with such at least one chordophone surface when the at least one plectrum is retained by such at least one plectrum retainer; wherein, when the at least one plectrum is retained by such at least one plectrum retainer, such at least one plectrum retainer is deformed; and wherein, when such at least one plectrum retainer is deformed, the plectrum is retained by frictional force against such at least one plectrum retainer.

Moreover, it provides such a system, wherein such at least one plectrum retainer comprises at least one retainer conformer structured and arranged to conform to such at least one retainer to the contour of the at least one chordophone surface. Additionally, it provides such a system, wherein such at least one retainer conformer comprises at least one elastomer. Also, it provides such a system wherein such at least one retainer conformer comprises at least one adhesive layer structured and arranged to removably attach such at least one plectrum retainer to the at least one chordophone surface. In addition, it provides such a system, wherein such at least one plectrum retainer comprises at least one printable material. And, it provides such a system, wherein such at least one printable material comprises ethylene-vinyl acetate.

Further, it provides such a system, wherein such at least one elastomer comprises ethylene-vinyl acetate. Even further, it provides such a system, wherein: such at least one plectrum retainer comprises at least one indicia; and such at least one indicia is not obscured from user viewing when the at least one plectrum is retained. Moreover, it provides such a system, wherein such at least one plectrum retainer forms, in combination with the at least one chordophone surface, when such at least one plectrum retainer is attached to the at least one chordophone surface, at least one pocket structured and arranged to hold at least one portion of the at least one plectrum. Additionally, it provides such a system, wherein such at least one plectrum retainer comprises at least one strip structured and arranged to retain a plurality of the plectrums. Also, it provides such a system, wherein such at least one strip is structured and arranged to be placed along at least one side of a guitar body. In addition, it provides such a system, wherein such at least one strip is structured and arranged to be placed within the perimeter of at least one side of a guitar body.

And, it provides such a system, wherein: such at least one plectrum retainer forms, in combination with the at least one chordophone surface, when such at least one plectrum retainer is attached to the at least one chordophone surface, at least one pocket structured and arranged to hold at least one portion of the at least one plectrum; and such at least one strip comprises a plurality of such at least one pockets, each respective such pocket being separated from each other such pocket. Further, it provides such a system, wherein such at least one strip comprises about eight inches in length and about one-and one quarter inches in height. Even further, it provides such a system, wherein: such at least one pocket comprises a dimension of about one inch wide; and each such at least one pocket is at least about one-half inch from each other such at least one pocket. Even further, it provides such a system, further comprising: at least one chordophone body comprising the at least one chordophone surface.

In accordance with another preferred embodiment hereof, this invention provides a method, of using the at least one plectrum retainer, comprising the steps of: receiving at least one request from at least one customer to provide the at least one plectrum retainer, wherein such at least one request includes at least one description of at least one indicia; providing such at least one plectrum retainer; arranging for such at least one indicia to be reproduced upon at least one surface of the at least one plectrum retainer; providing for delivery for value of the at least one plectrum retainer bearing the at least one indicia to the at least one customer.

Even further, it provides such a method, wherein placement of such at least one indicia upon such at least one surface of the at least one plectrum retainer is located so that such at least one indicia is not obscured from user view during use of the at least one plectrum retainer when the at least one plectrum retainer contains at least one plectrum. Even further, it provides such a method, wherein such at least one plectrum retainer structured and arranged to retain at least one plectrum comprises at least one strip structured and arranged to retain a plurality of the plectrums.

In accordance with another preferred embodiment hereof, this invention provides a plectrum retainer system comprising: plectrum retainer means for retaining at least one plectrum against at least one chordophone surface; and angle positioner means for positioning the at least one plectrum at least one acute angle with such at least one chordophone surface when the at least one plectrum is retained by such plectrum retainer means; wherein, when the at least one plectrum is retained by such plectrum retainer means, such plectrum retainer means is deformed; and wherein, when such plectrum retainer means is deformed, the plectrum is retained by frictional force against such plectrum retainer means.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
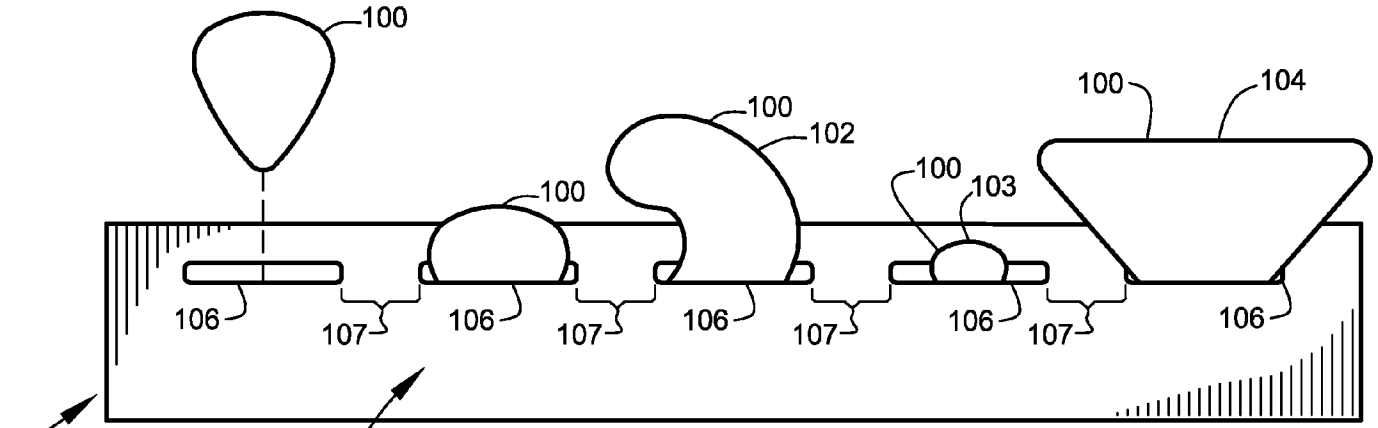
FIG. 1 shows a front view, illustrating plectrum holder for holding multiple plectrums of a variety of shapes retained in receptacles, according to a preferred embodiment of the present invention.

FIG. 1 shows a front view illustrating plectrum holder 105 holding multiple plectrums 100 of a variety of shapes retained in receptacles 106, according to a preferred embodiment of the present invention. Plectrum holder 105 preferably comprises at least one receptacle 106 and at least one spacing 107, as shown. A variety of shapes (and thicknesses) for plectrum 100, such as curved plectrum 102, small plectrum 103, and pyramid plectrum 104, are preferably held by receptacle 106 of plectrum holder 105, as shown. Plectrum holder 105 has a large exposed frontal surface area 108 available for reproduction of custom graphic images. A plurality of spacings 107 between receptacles 106 (at least embodying herein wherein such at least one plectrum retainer structured and arranged to retain at least one plectrum comprises at least one strip structured and arranged to retain a plurality of the plectrums) along the length of plectrum holder 105 provide a layout for receptacles 106. Ethylene-vinyl acetate ("EVA") EVA is a preferred material for constructing plectrum holder 105 (at least embodying herein wherein such at least one retainer conformer comprises at least one elastomer). Preferably, plectrum holder comprises essentially 2 mm (2-millimeter thick) EVA foam. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, rubber, silicone, etc., may suffice.

Figure 6:
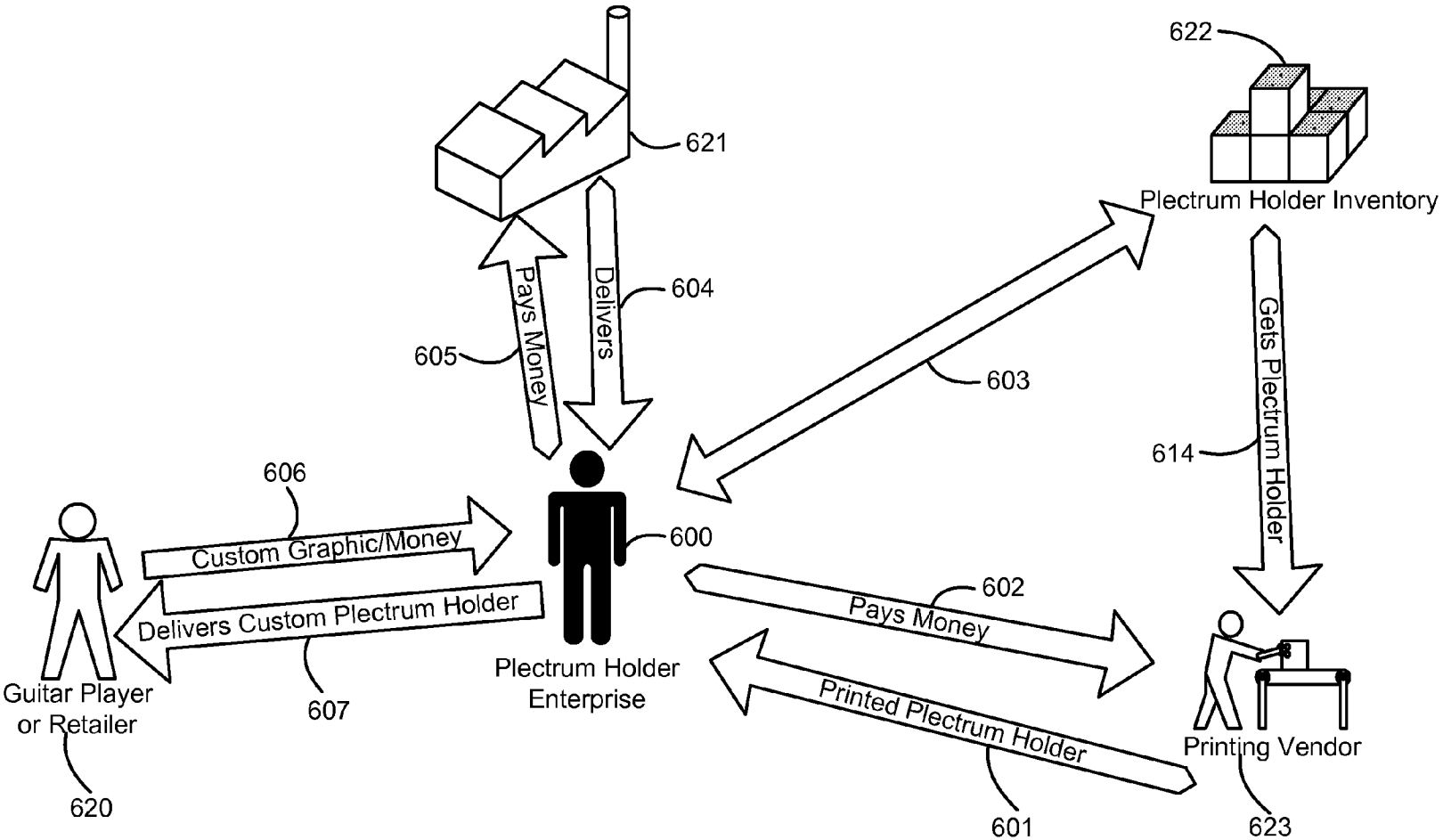
FIG. 6 shows a flow diagram of monetary value and goods flowing between entities for monetizing a "printed" plectrum holder according to a preferred embodiment of the present invention.

At least one preferable characteristic of the material for constructing plectrum holder 105 is to provide a surface suitable for applying ink and/or paint such that it will permanently adhere (see FIG. 6). The above-described arrangement for plectrum holder 105 at least embodies herein wherein such at least one plectrum retainer comprises at least one printable material. Upon reading this specification, those with ordinary skill in the art will now appreciate that, under appropriate circumstances, considering such issues as design preference, user preferences, marketing preferences, cost, structural requirements, available materials, technological advances, etc., other printing arrangements such as, for example, logo's, graphics, fluorescents (glow in the dark), etc., may suffice.

Figure 2A:
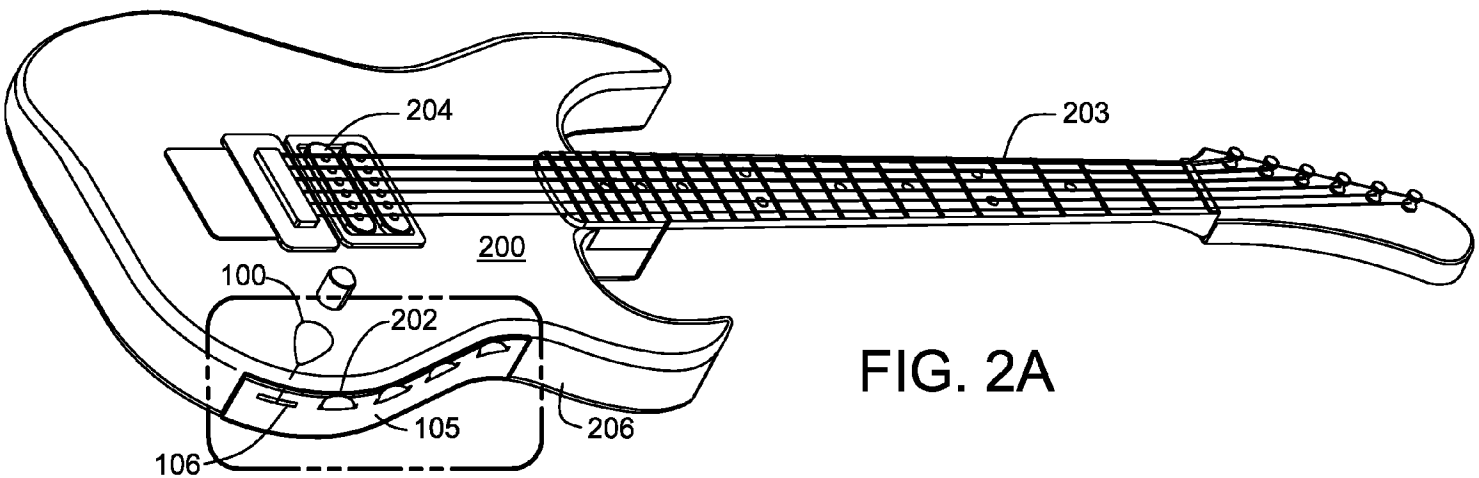
FIG. 2A shows a perspective view, illustrating guitar body with attached plectrum holder holding multiple plectrums, according to the preferred embodiment of FIG. 1.

FIG. 2A shows a perspective view, illustrating guitar body 200 with attached plectrum holder 105 holding multiple plectrums 100, according to the preferred embodiment of FIG. 1. Guitar body 200 preferably comprises at least one guitar body side 206, at least one string 203, and at least one electronic pick-up 204, as shown. Plectrum holder 105 preferably conforms to multiple contours of guitar body 200 (at least embodying herein at least one chordophone body comprising the at least one chordophone surface) due to adhesive coating 311 (see FIG. 3A), as shown. A guitar player preferably may attach plectrum holder 105 to any desired location of guitar body side 206 providing there is sufficient surface area 108 allowing adhesive coating 311 to form receptacle 106. Alternately preferably, plectrum holder 105 is placed entirely within the perimeter of at least one guitar body side 206, as shown. Additionally preferably, plectrum holder 105 may be attached to any suitable surface of guitar body 200. Upon reading this specification, those with ordinary skill in the art will now appreciate that, under appropriate circumstances, considering such issues as design preference, user preferences, marketing preferences, cost, structural requirements, available materials, technological advances, etc., other attachment arrangements such as, for example, mechanical fastening, removable adhesive, etc., may suffice.

Figure 2B:
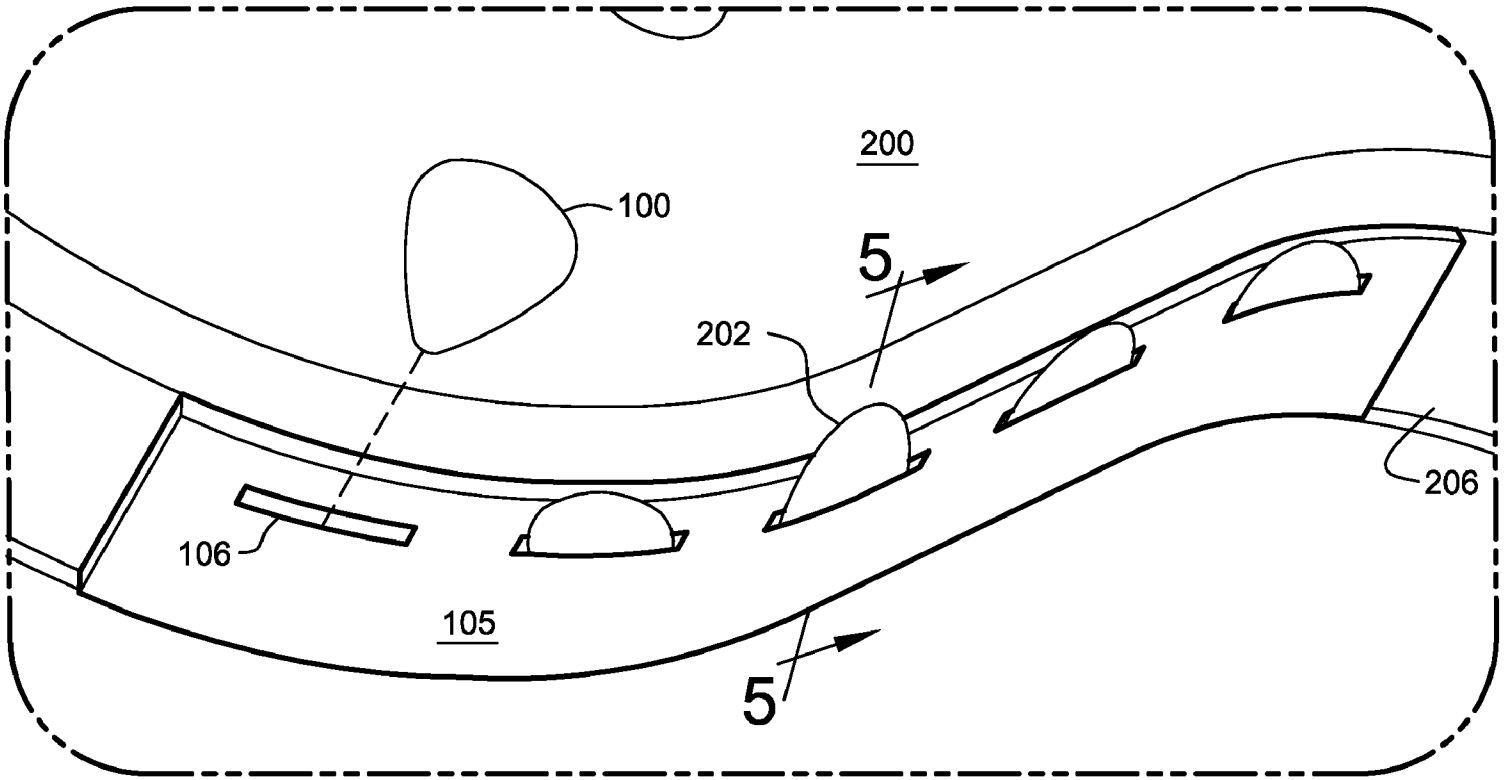
FIG. 2B shows an enlarged view of guitar body with attached plectrum holder, illustrating the flexible characteristic of plectrum holder, according to the preferred embodiment of FIG. 2.

FIG. 2B shows an enlarged view of guitar body 200 with attached plectrum holder 105 illustrating the flexible characteristic of plectrum holder 105, according to the preferred embodiment of FIG. 1. Plectrum holder 105 (at least embodying herein plectrum retainer means for retaining at least one plectrum against at least one chordophone surface) preferably holds a plurality of plectrums by providing a plurality of receptacles 106 (at least embodying herein such at least one strip comprises a plurality of such at least one pockets, each respective such pocket being separated from each other such pocket) for the guitar player to insert plectrums 202, as shown. The low profile characteristic of plectrum holder 105 preferably allows guitar body 200, with plectrum holder 105 installed, to fit into a standard guitar case with little or no interference from plectrum holder 105.

Preferably, each respective receptacle 106 preferably is about one-half inch wide and about one-eighth inch in depth, with each respective receptacle 106 of said plurality of receptacles 106 being about one-half inch apart from each other receptacle 106, or in other words, having a spacing 107 of about one-half inch, as shown. Preferably, at least one embodiment of plectrum holder 105 has a preferred overall dimension of about eight inches in length and about one-and one-quarter inches in height. Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, those fitting other shapes, sizes, chordophone bodies, etc., may suffice. Additionally, upon reading this specification, those with ordinary skill in the art will now appreciate that, under appropriate circumstances, considering such issues as design preference, user preferences, marketing preferences, cost, structural requirements, available materials, technological advances, etc., other shapes of plectrum holder, such as, for example, pickguard shaped, character shaped, guitar shaped, culturally-recognizable-indicia shaped, custom shaped to a particular graphic design, etc., may suffice.

Figure 3A:
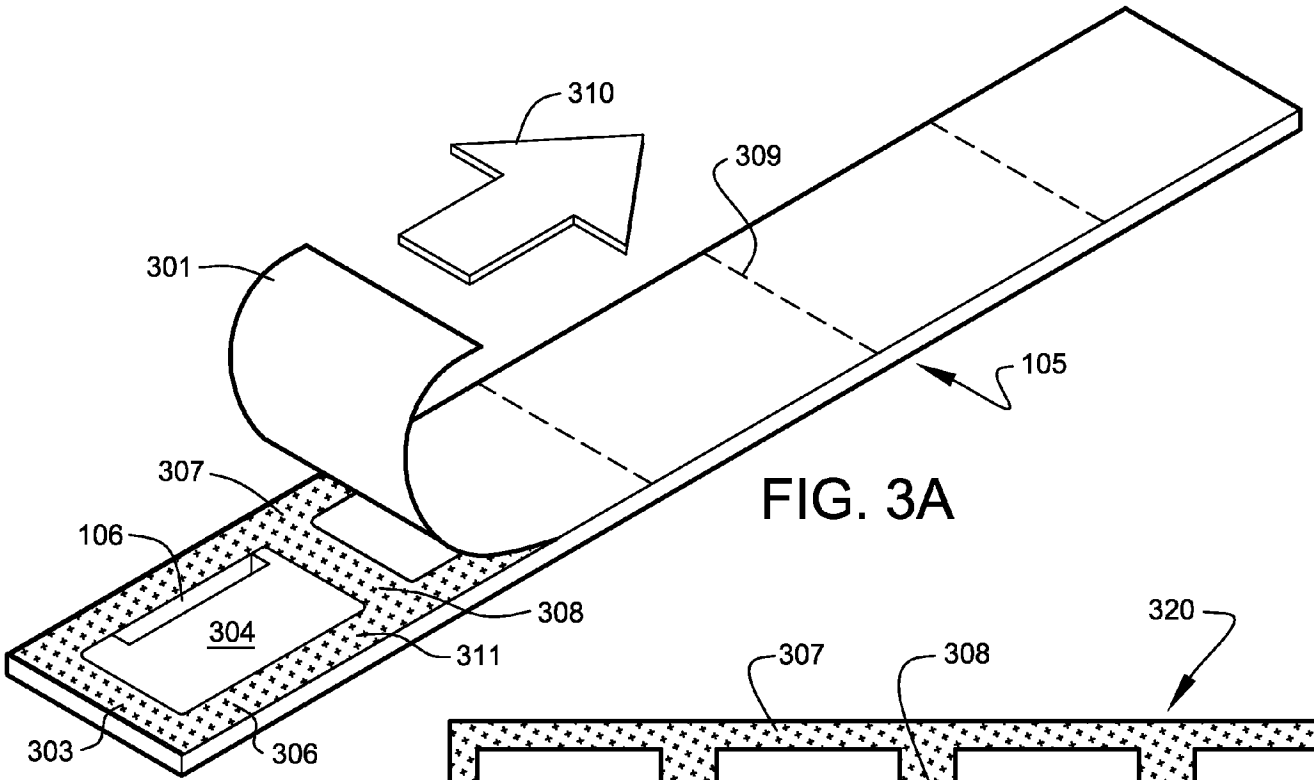
FIG. 3A shows a back view of plectrum holder with adhesive coating and protector sheet, according to the preferred embodiment of FIG. 1.

FIG. 3A shows a back view of plectrum holder 105 with adhesive coating 311 and protector sheet 301, according to the preferred embodiment of FIG. 1. Back side 312 (see FIG. 5) of plectrum holder 105 preferably comprises at least one adhesive coating 311, at least one protector sheet 301, at least one receptacle pocket 304, and at least one receptacle 106, as shown. Plectrum holder 105, preferably comprising a plurality of receptacles 106 (see FIG. 2B), also preferably comprises at least one centerline 309. Centerline 309 preferably shows where to cut for reducing the number of receptacles 106 to attach to guitar body 200. Adhesive coating 311 (at least embodying herein wherein such at least one retainer conformer comprises at least one adhesive layer structured and arranged to removably attach such at least one plectrum retainer to the at least one chordophone surface) around receptacle pocket 304 preferably comprises at least one left adhesive layer 303, at least one right adhesive layer 308, at least one top adhesive layer 307, and at least one bottom adhesive layer 306 forming receptacle pocket 304. Plectrum holder 105 preferably may be used on most chordophones.

At least one receptacle 106 is formed, preferably using die-cutting technology, preferably prior to application of adhesive coating 311, in base material of EVA (this arrangement at least embodies herein wherein such at least one printable material comprises ethylene-vinyl acetate). Adhesive coating 311, preferably a sheet with adhesive on each side, is preferably formed to preferred shape, preferably using die-cutting technology. Upon reading the teachings of this specification, those of ordinary skill in the art will now understand that, under appropriate circumstances, considering such issues as manufacturing technology advancement, advances in materials, etc., other manufacturing technology (than die cutting), materials, such as, laser cutting, etc., may suffice.

Upon reading the teachings of this specification, those of ordinary skill in the art will now understand that, under appropriate circumstances, considering such issues as technology advances in material technology, advances in music material technology, future chordophone shaped, etc., other plectrum holder materials other than EVA, such as, advanced elastomeric materials, photonic emitting material, rubber, silicone, etc., may suffice.

Protector sheet 301 preferably protects adhesive coating 311 from contamination that would prevent adhesive coating 311 from working to full capacity. User preferably peels off, preferably in the direction of pull direction 310, protector sheet 301 from plectrum holder 105 exposing adhesive coating 311. User preferably installs plectrum holder 105, preferably so that the full length is in contact with guitar body 200 (see FIG. 2A). The above-described arrangement at least embodies herein wherein such at least one plectrum retainer comprises at least one retainer conformer structured and arranged to conform to such at least one retainer to the contour to the at least one chordophone surface.

Figure 3B:
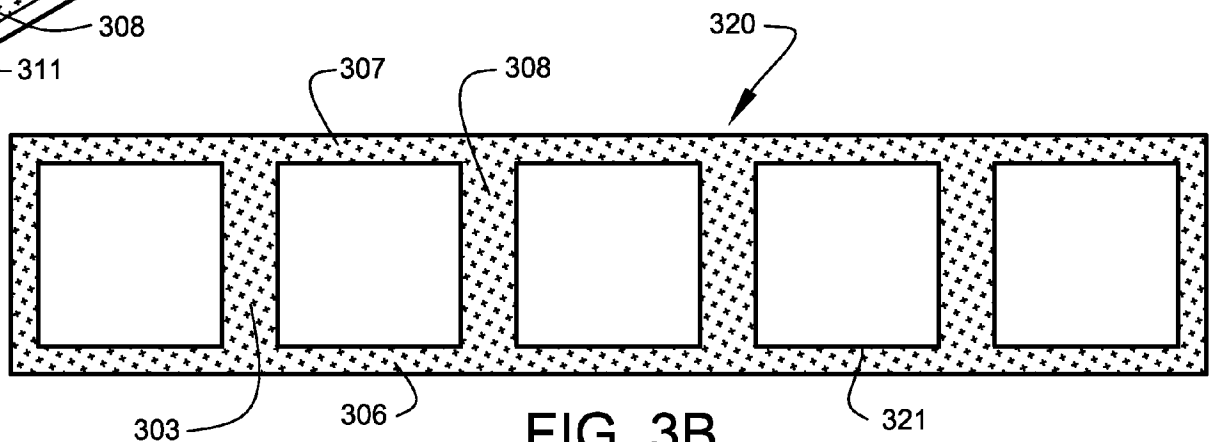
FIG. 3B shows orthographically a sheet of adhesive coating, according to the preferred embodiment of FIG. 3A.

FIG. 3B shows orthographically a sheet of adhesive coating 320, according to the preferred embodiment of FIG. 3A. Adhesive coating 320 preferably comprises a sheet that has been die cut to form pocket voids 321 surrounded by at least one left adhesive layer 303, at least one bottom adhesive layer 306, at least one top adhesive layer 307, and at least one right adhesive layer 308, as shown. Adhesive coating 320 preferably comprises the following characteristics: self-sticking adhesion that will not detach until manually removed; will allow physical peeling off of the plectrum holder 105 without damaging the plectrum holder 105; will not leave any adhesive residue on the chordophone surface. Those with ordinary skill in the art of adhesive attachment, without undue experimentation, will be able to identify families of adhesive that will match the above-described preferences.

Figure 4:
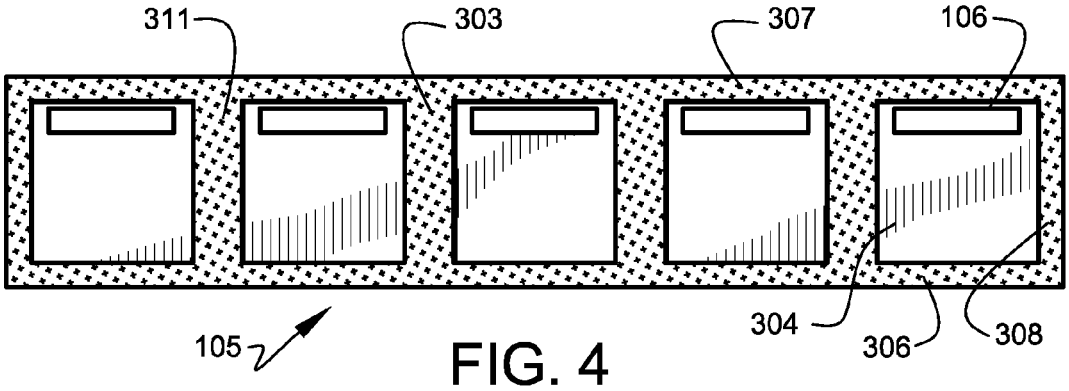
FIG. 4 shows a pattern of adhesive coating on the back of plectrum holder, according to the preferred embodiment of FIG. 1.

FIG. 4 shows a pattern of adhesive coating 311 on the back of plectrum holder 105, according to the preferred embodiment of FIG. 1. After adhesive coating 320 (see FIG. 3B) is cut, it is then applied to plectrum holder 105 as adhesive coating 311. Adhesive coating 320 is cut preferably using die cutting technology. Adhesive coating 311 preferably forms the sides of at least one receptacle pocket 304 preferably including at least one bottom adhesive layer 306, at least one right adhesive layer 308, at least one top adhesive layer 307, and at least one left adhesive layer 303, as shown. Upon reading the teachings of this specification, those of ordinary skill in the art will now understand that, under appropriate circumstances, considering such issues as manufacturing adhesive application technology, adhesive advancement, etc., other adhesive application, adhesive layouts, such as, sprayed on adhesive, dot patterns, line patterns, adhesives integral with the plectrum holder material, etc., may suffice.

Figure 5:
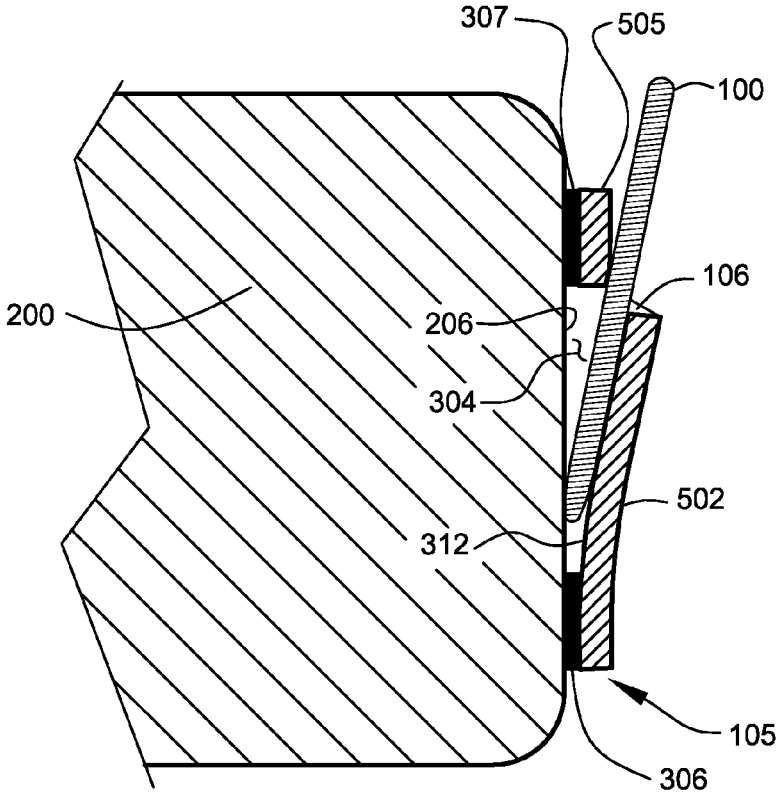
FIG. 5 shows the cross-sectional view 5-5, of FIG. 2B.

FIG. 5 shows the cross-sectional view 5-5, of FIG. 2B. Plectrum holder 105 installed on guitar body 200 with plectrum 100 inserted into receptacle 106, as shown. Receptacle 106 preferably comprises at least one guitar body side 206, at least one bottom adhesive layer 306, at least one top adhesive layer 307, at least one receptacle pocket 304 (at least embodying herein such at least one plectrum retainer forms, in combination with the at least one chordophone surface, when such at least one plectrum retainer is attached to the at least one chordophone surface, at least one pocket structured and arranged to hold at least one portion of the at least one plectrum), at least one receptacle top 505, and at least one receptacle side 502 (at least embodying herein wherein, when the at least one plectrum is retained by such plectrum retainer means, such plectrum retainer means is deformed), as shown. At least one plectrum 100, inserted into receptacle 106, is preferably held in place by the force exerted on plectrum 100 preferably resulting from the deformation of receptacle side 502. The force of receptacle side 502 preferably transfers via plectrum 100 to receptacle top 505 (at least embodying herein angle positioner means for positioning the at least one plectrum at least one acute angle with such at least one chordophone surface when the at least one plectrum is retained by such plectrum retainer means) and guitar body side 206 preferably increasing friction on plectrum 100 (at least embodying herein wherein, when such plectrum retainer means is deformed, the plectrum is retained by frictional force against such plectrum retainer means) and creating a holding force. Upon reading the teachings of this specification, those of ordinary skill in the art will now understand that, under appropriate circumstances, considering such issues as chordophone size, multiple chordophone sides, etc., other sides with sufficient surface area may be used to attach plectrum holder, such as, top, bottom, neck, side, etc., may suffice.

FIG. 6 shows a flow diagram of monetary value and goods between entities for monetizing plectrum holder. Plectrum holder enterprise 600, preferably desiring to monetize the present invention, preferably prints custom graphics 606 on plectrum holder units 614. Custom graphic 606 and monetary consideration are preferably received from customer 620 by plectrum holder enterprise 600. Plectrum holder enterprise 600 preferably transfers custom graphic 606 to graphic applicator 623 along with appropriate quantity of plectrum holder units 614. Graphic applicator 623 preferably reproduces custom graphic 606 onto plectrum holders 601 and returns them to plectrum holder enterprise 600. Plectrum holder enterprise 600 preferably provides custom plectrum holders 607 to customer 620, as shown.

Plectrum holder enterprise 600 preferably pays money 605 to manufacturing 621 for producing plectrum holder units 604. Plectrum holder enterprise 600 preferably receives plectrum holder units 604 and puts plectrum holder units 603 into inventory 622. Inventory 622 is available for preferably delivering plectrum holder units 614 to graphic applicator 623. Plectrum holder enterprise 600 preferably may produce printed plectrum holders 601 with generic graphic design to sell to customer 620. Customer 620 preferably may be at least one individual or at least one retailer.

Figure 7:
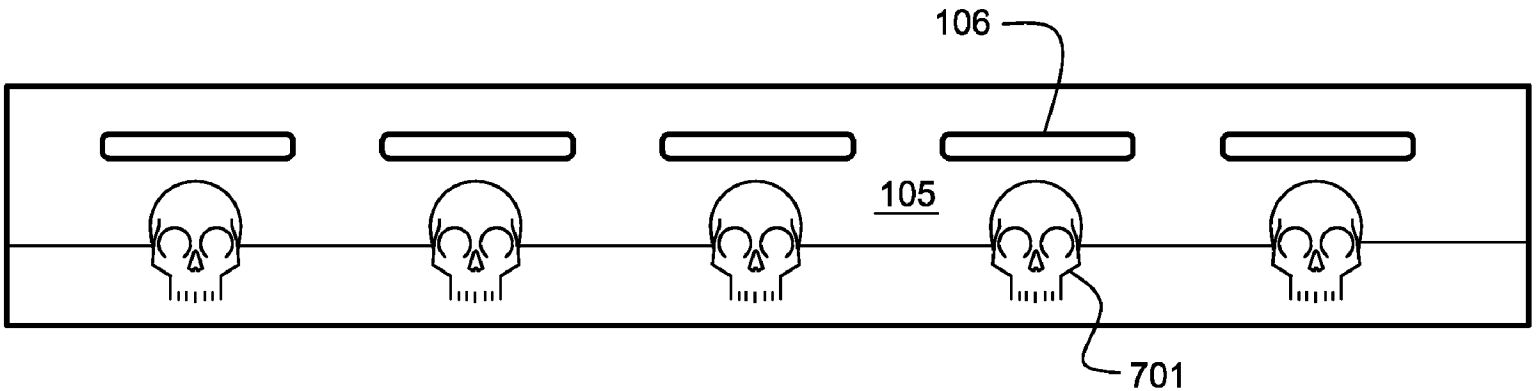
FIG. 7 shows an illustration of a finished plectrum holder with desired graphic design having been reproduced on the front side, according to a preferred embodiment of the present invention.

FIG. 7 shows an illustration of a finished plectrum holder 105 with desired graphic design 701 having been reproduced on the front side. Plectrum holder 105 is preferably a completed product with reproduced graphic design 701 of customer 620 and preferably comprising five receptacles 106. Graphic design 701 is preferably supplied by customer 620 when desiring a custom presentation on their plectrum holder 105. Upon reading this specification, those with ordinary skill in the art will now appreciate that, under appropriate circumstances, considering such issues as design preference, user preferences, marketing preferences, cost, structural requirements, available materials, technological advances, etc., other receptacle arrangements such as, for example, more or less than five, one receptacle, six receptacles, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A plectrum retainer system comprising:

a) at least one plectrum retainer structured and arranged to retain at least one plectrum against, and in contact with, at least one chordophone surface; and b) at least one angle positioner structured and arranged to position the at least one plectrum at least one acute angle with the at least one chordophone surface when the at least one plectrum is retained by said at least one plectrum retainer;

c) wherein, when the at least one plectrum is retained by said at least one plectrum retainer, said at least one plectrum retainer is deformed; and d) wherein, when said at least one plectrum retainer is deformed, the plectrum is retained by frictional force against said at least one plectrum retainer.

2. The system, according to claim 1, wherein said at least one plectrum retainer comprises at least one retainer conformer structured and arranged to conform said at least one plectrum retainer to the contour of the at least one chordophone surface.

3. The system, according to claim 2, wherein said at least one retainer conformer comprises at least one elastomer.

4. The system, according to claim 2, wherein said at least one retainer conformer comprises at least one adhesive layer structured and arranged to removably attach said at least one plectrum retainer to the at least one chordophone surface.

5. The system, according to claim 1, wherein said at least one plectrum retainer comprises at least one printable material.

6. The system, according to claim 5, wherein said at least one printable material comprises ethylene-vinyl acetate.

7. The system, according to claim 3, wherein said at least one elastomer comprises ethylene-vinyl acetate.

8. The system, according to claim 5, wherein:

a) said at least one plectrum retainer comprises at least one indicia; and b) said at least one indicia is not obscured from user viewing when the at least one plectrum is retained.

9. The system, according to claim 4, wherein said at least one plectrum retainer forms, in combination with the at least one chordophone surface, when said at least one plectrum retainer is attached to the at least one chordophone surface, at least one pocket structured and arranged to hold at least one portion of the at least one plectrum.

10. The system, according to claim 4, wherein said at least one adhesive layer is:

a) adherable to the at least one chordophone surface; and b) manually removable without damaging said at least one plectrum retainer or the at least one chordophone surface;

c) wherein, when said at least one adhesive layer is manually removed, there is essentially no adhesive residue on the at least one chordophone surface.

11. The system, according to claim 1, wherein said at least one plectrum retainer comprises at least one strip structured and arranged to retain a plurality of the plectrums.

12. The system, according to claim 11, wherein said at least one strip is structured and arranged to be placed along at least one side of a guitar body.

13. The system, according to claim 11, wherein said at least one strip is structured and arranged to be placed within the perimeter of at least one side of a guitar body.

14. The system, according to claim 11, wherein:

a) said at least one plectrum retainer forms, in combination with the at least one chordophone surface, when said at least one plectrum retainer is attached to the at least one chordophone surface, at least one pocket structured and arranged to hold at least one portion of the at least one plectrum; and b) said at least one strip comprises a plurality of such at least one pockets, each respective such pocket being separated from each other such pocket.

15. The system, according to claim 14, wherein said at least one strip comprises about eight inches in length and about one-and one quarter inches in height.

16. The system, according to claim 15, wherein:

a) such at least one pocket comprises a dimension of about one inch wide; and b) each such at least one pocket is at least about one-half inch from each other such at least one pocket.

17. The system, according to claim 1, further comprising at least one chordophone body comprising the at least one chordophone surface.

18. The system, according to claim 1, further comprising at least one indicia reproduced upon at least one surface of said at least one plectrum retainer.

19. The system, according to claim 18, wherein placement of said at least one indicia upon such at least one surface of said at least one plectrum retainer is located so that said at least one indicia is not obscured from user view during use of said at least one plectrum retainer when said at least one plectrum retainer contains the at least one plectrum.

20. The system, according to claim 19, wherein said at least one plectrum retainer comprises at least one strip structured and arranged to retain a plurality of the plectrums.

21. A plectrum retainer system comprising:

a) plectrum retainer means for retaining at least one plectrum against, and in contact with, at least one chordophone surface; and b) angle positioner means for positioning the at least one plectrum at least one acute angle with the at least one chordophone surface when the at least one plectrum is retained by said plectrum retainer means;

c) wherein, when the at least one plectrum is retained by said plectrum retainer means, said plectrum retainer means is deformed; and d) wherein, when said plectrum retainer means is deformed, the plectrum is retained by frictional force against said plectrum retainer means.

* * * * *

UNITED STATES PATENT AND TRADEMARK OFFICE

CERTIFICATE OF CORRECTION

PATENT NO. : 8,097,799 B2
APPLICATION NO. : 12/568648
DATED : January 17, 2012
INVENTOR(S) : Tran et al.

It is certified that error appears in the above-identified patent and that said Letters Patent is hereby corrected as shown below:

Column 8, Claim 1, line 2, "plectrum at least one acute" should read --plectrum at at least one acute--

Signed and Sealed this
Seventeenth Day of April, 2012

David J. Kappos

David J. Kappos
*Director of the United States Patent and Trademark Office*